US007264011B2

(12) United States Patent
Cohen

(10) Patent No.: US 7,264,011 B2
(45) Date of Patent: Sep. 4, 2007

(54) TREE MOUNTED UMBRELLA ASSEMBLY AND METHOD OF APPLICATION

(76) Inventor: Warren Cohen, 10981 Decatur Rd., Philadelphia, PA (US) 19154

( * ) Notice: Subject to any disclaimer, the term of this patent is extended or adjusted under 35 U.S.C. 154(b) by 289 days.

(21) Appl. No.: 10/778,867

(22) Filed: Feb. 17, 2004

(65) Prior Publication Data

US 2005/0178415 A1 Aug. 18, 2005

(51) Int. Cl.
*A45B 11/00* (2006.01)

(52) U.S. Cl. ..... 135/21; 135/20.1; 135/90; 135/901; 182/92

(58) Field of Classification Search ..... 135/21, 135/90, 161, 901, 905, 20.1, 15–16, 98, 155; 43/1; 182/92, 187; 248/217.4
See application file for complete search history.

(56) References Cited

U.S. PATENT DOCUMENTS

| | | | | | |
|---|---|---|---|---|---|
| 176,145 | A * | 4/1876 | McRedmond | ..... | 135/21 |
| 350,262 | A * | 10/1886 | McAuliffe | ..... | 135/21 |
| 1,652,667 | A * | 12/1927 | Greenberg | ..... | 135/16 |
| 4,284,095 | A | 8/1981 | Norton | ..... | 135/21 |
| 4,326,301 | A * | 4/1982 | Brock | ..... | 135/16 |
| 4,458,707 | A * | 7/1984 | Lindaman | ..... | 135/90 |
| 4,739,785 | A | 4/1988 | Poulson | ..... | 135/117 |
| 5,787,914 | A * | 8/1998 | Greywall | ..... | 135/90 |
| 5,937,881 | A * | 8/1999 | Villa | ..... | 135/20.1 |
| 6,148,836 | A * | 11/2000 | Cananzey | ..... | 135/87 |
| 2002/0036007 | A1 * | 3/2002 | Sellers | ..... | 135/90 |

* cited by examiner

*Primary Examiner*—Winnie Yip
(74) *Attorney, Agent, or Firm*—LaMorte & Associates

(57) ABSTRACT

An assembly having an umbrella and a mounting bracket for mounting the umbrella to a vertical object. The mounting bracket engages the top of the umbrella, thereby suspending the umbrella from a position above the umbrella. The umbrella has a finial cap at the top of the umbrella. Part of the finial cap extends out above the canopy of the umbrella. This portion of the finial cap is selectively received by the shaped head of the mounting bracket. The finial cap is annular and defines a central opening through which the support post of the umbrella can pass. When the umbrella is opened, the support post extends out through the finial cap above the canopy. The result is a mounting umbrella with nothing protruding below the umbrella.

12 Claims, 3 Drawing Sheets

TREE MOUNTED UMBRELLA ASSEMBLY AND METHOD OF APPLICATION

BACKGROUND OF THE INVENTION

1. Field of the Invention

In general, the present invention relates to umbrellas and structures used to support umbrellas. More particularly, the present invention relates to umbrella designs that are specifically designed to mount to a tree or similar vertical structure.

2. Description of the Prior Art

The prior art is replete with different types of umbrellas. Typically, prior art umbrellas include a circular canopy supported by a central post that descends downwardly from the center of the canopy. This umbrella structure works well when a person has a free hand to hold the post of the umbrella and is capable of standing under the center of the umbrella. However, there are many circumstances that exist where an umbrella is needed, yet a person cannot hold the umbrella and cannot stand under the center of the umbrella. One such circumstance is when a person is hunting in a tree stand that is supported in a tree.

Tree stands are structures that are built in a tree or mounted to a tree to enable a hunter to comfortably stand or sit. Although some hunters build tree stands, many hunters prefer to use portable tree stands that can be moved from tree to tree as desired. Portable tree stands typically strap or otherwise mount to the trunk of a tree. As such, when a hunter is in the tree stand, the hunter is standing immediately adjacent to the trunk of the tree. A hunter in a tree stand is typically holding a weapon, binoculars or other equipment. As such, a hunter positioned in a tree stand typically does not have a free hand available to hold an umbrella.

There are many mounting devices that are used to mount umbrellas to a variety of objects. For example, there are umbrella mounting devices used to mount umbrellas to deck rails, beach chairs and picnic tables. However, in a tree stand, there is typically nothing, other than the tree, that is available to mount an umbrella.

Umbrellas, however, are very desirable to have in a tree stand. Hunters can stand or sit in a tree stand constantly for many hours. During inclement weather, an umbrella can keep a hunter and the hunter's equipment dry. Even during good weather conditions umbrellas are advantageous to have in tree stands. Umbrellas shield a hunter from the sun and help camouflage a hunter from sight. Many hunters also use umbrellas to support camouflaged blinds that protect the hunters from being observed by their prey.

Mounting an umbrella over a tree stand is not an easy endeavor. Since the trunk of a tree is typically immediately adjacent the tree stand, a traditional umbrella cannot be opened directly over the tree stand. This is because the tree interferes with the open canopy of the umbrella. It is for this reason that specialty umbrellas have been designed for use in tree stands.

U.S. Pat. No. 4,739,785 to Poulson, entitled Hunter's Canopy, discloses a semicircular umbrella canopy that connects directly to the tree trunk so that the canopy radially extends from the tree trunk. In such prior art constructions, a full round canopy is not used, thus the area covered by the canopy is limited. Furthermore, such prior art devices can only be used along portions of a tree that are smooth, straight and lack lateral branches.

U.S. Pat. No. 4,284,095 to Norton, entitled Top-erected Umbrella With Cantilevered Support, shows a circular umbrella canopy that is supported at the top of the canopy by a flexible cord. Although the umbrella is designed to be mounted in a tree, the canopy is only supported by a flexible cord. As such, the canopy can move in the wind. This is highly undesirable for a hunter, because such movement gives away the position of the hunter to approaching prey. Furthermore, since the Norton umbrella is suspended from a flexible cord, the canopy of the umbrella only hangs straight down and cannot be angled to block rain or sun that is falling upon the hunter at an angle.

A need therefore exists for an umbrella assembly that can be used on a tree stand, wherein the umbrella assembly provides full coverage of the tree stand, does not obstruct the movements of the hunter, and can be selectively angled to block blowing rain and sun. These needs are met by the present invention as described and claimed below.

SUMMARY OF THE INVENTION

The present invention is an assembly having an umbrella and a mounting bracket for mounting the umbrella to a vertical object, such as a tree. The mounting bracket engages the top of the umbrella, thereby suspending the umbrella from a position above the umbrella.

The mounting bracket has a shaft that is driven into a tree or similar vertical object. The shaft of the mounting bracket supports a shaped head that is sized to receive and engage the top of the umbrella. The umbrella has a finial cap at the top of the umbrella. Part of the finial cap extends out above the canopy of the umbrella. This portion of the finial cap is selectively received by the shaped head of the mounting bracket. Although the remainder of the umbrella can have a traditional configuration, the preferred umbrella configuration of the present invention is unique. The preferred umbrella configuration has a vertical support post that extends down from the center of the canopy. The finial cap at the top of the umbrella is annular and defines a central opening through which the support post can pass. The support post of the umbrella extends through the central opening in the finial cap. Support ribs are coupled to the finial cap under the canopy. The support ribs expand outwardly when the support post is advanced upwardly toward the finial cap. The canopy of the umbrella is disposed around said support ribs. When the umbrella is opened, the support post extends out through the finial cap above the canopy. The result is a mounting umbrella with nothing protruding below the umbrella. This enables a person to move freely under the umbrella without having to avoid any part of the umbrella or its mount.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention umbrella assembly can be used in many locations, such as on a home deck, the present invention umbrella assembly is particularly well suited for use by a person standing or sitting in a tree stand. Accordingly, by way of example, the present invention umbrella assembly is described in an application where it is being attached to a tree over a tree stand in order to set forth the best mode contemplated for the invention. However, the description and illustration of the invention in a tree should not be considered a limitation of the umbrella assembly to other vertical structures, such as poles and walls.

Figure 1:
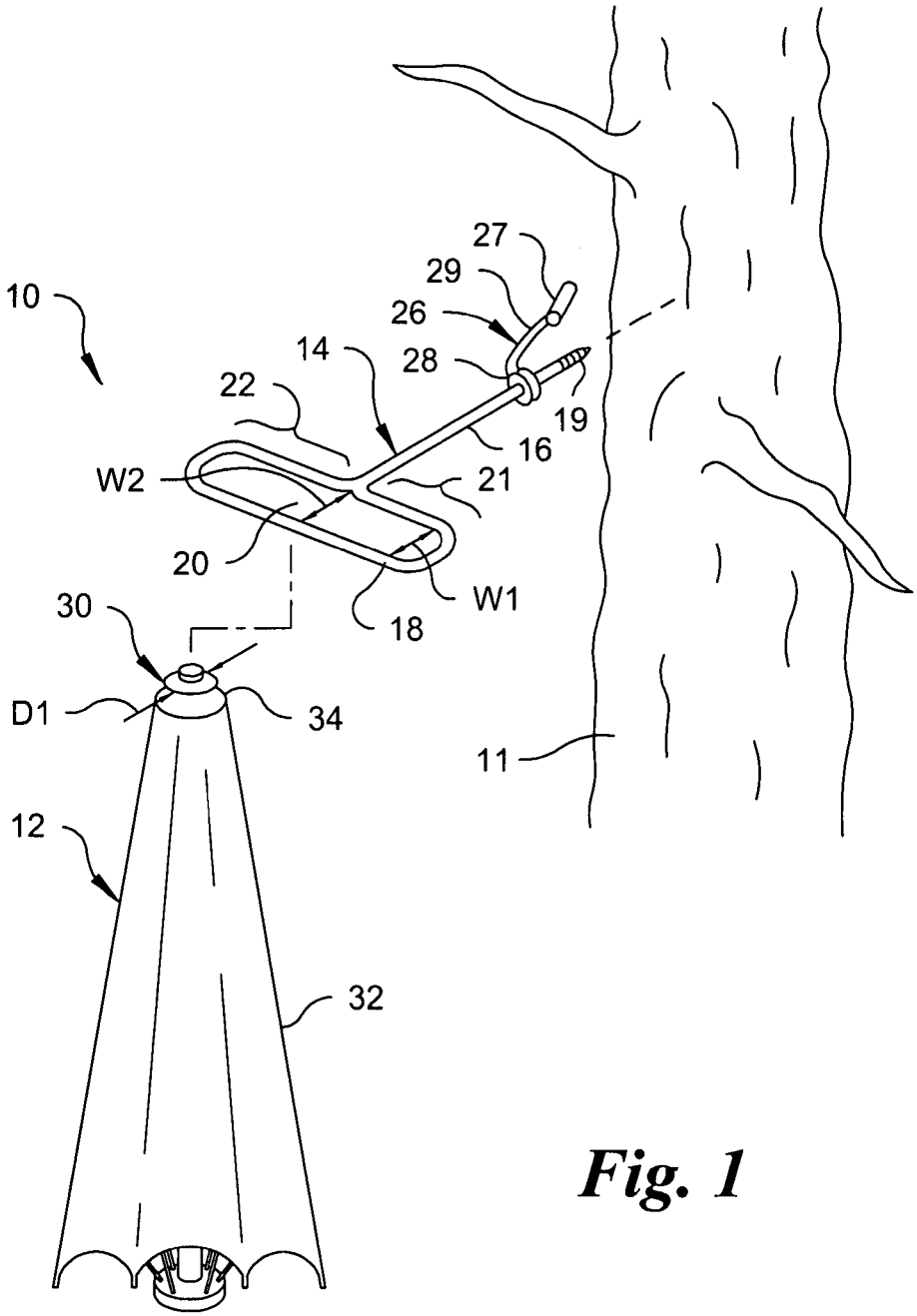
FIG. 1 is an exploded perspective view of a preferred embodiment of the present invention assembly.

Referring to FIG. 1, a first exemplary embodiment of the present invention assembly 10 is shown. The assembly 10 consists of a novel umbrella 12 and a mounting bracket 14 for the umbrella 12. The mounting bracket 14 is specifically designed to engage vertical objects, such as a tree 11. However, the mounting bracket 14 can engage any other wooden structure, such as a wooden pole, fence post or the like. The mounting bracket 14 engages the top of the umbrella 12 and holds the umbrella 12 from a point above the center of the umbrella 12. However, the mounting bracket 14 rigidly holds the umbrella 12 so it is not moved by the wind. Yet, the mounting bracket 14 allows the position and angle of the umbrella 12 to be selectively altered by a user, as will later be explained.

The mounting bracket 14 is generally T-shaped, having a shaft 16 and a slotted head 18 that extends in opposite directions at a perpendicular to the shaft 16. The shaft 16 of the mounting bracket 14 has a threaded end 19 at the end of the shaft 16 opposite the slotted head 18. This enables the shaft 16 of the mounting bracket 14 to engage any wooden object such as a tree, wall or post. The threaded end 19 of the mounting bracket 14 is screwed into a wooden object by turning the slotted head 18 and rotating the shaft 16 of the mounting bracket 14. In an alternate embodiment, the end of the shaft 16 may be pointed so that it can be driven into a tree 11 like a spike. The use of a threaded end 19, however, is preferred because it does not require the use of any tools to drive the shaft 16 into a tree.

The slotted head 18 of the mounting bracket 14 defines an elongated slot 20 that has opposing arms 21, 22. The shaft 16 intersects the slotted head 18 in between the opposing arms 21, 22. The elongated slot 20 has diverging sides. As such, the elongated slot in the first arm 21 is wider than the elongated slot in the second arm 22. At the beginning of the first arm 21, the elongated slot 20 is its widest, having a width W1. However, in the center of the elongated slot 20, in between the two opposing arms 22, the elongated slot 20 narrows to a second smaller width W2.

A safety cap 26 is also provided. The safety cap 26 has an end cap 27 that passes over the threaded end 19 of the mounting bracket 14. This covers the threaded end 19 of the mounting bracket 14 and prevents that threaded point 19 from inadvertently contacting any item that might be damaged by that point. The end cap 27 is retained by a hoop 28 and tether 29. The hoop 28 passes around the shaft 16 of the mounting bracket 14 and thus always remains with the mounting bracket 14.

The umbrella 12 of the present invention assembly 10 has a finial cap 30 that extends upwardly above the canopy 32 of the umbrella 12. The finial cap 30 defines a groove 34. The groove 34 has a diameter D1 that is just slightly smaller than the width W2 of the elongated slot 20 at its center. Above the groove 34, the finial cap 30 has a second diameter that is larger than the width W2 of the elongated slot 20 at its center, but smaller than the width W1 of the elongated slot 20 at its end. It will therefore be understood that the finial cap 30 can be inserted into the elongated slot 20 of the mounting bracket 14 at the end of the elongated slot 20. The finial cap 30 can then be moved laterally to the center of the elongated slot 20. The groove 34 of the finial cap 30 passes into the center of the elongated slot 20 where the contact between the groove 34 and the mounting bracket 14 prevents the finial cap 30 from being pulled out of the elongated slot 20 until the finial cap 30 is again moved laterally to the end of the elongated slot 20. As such, the finial cap 30 can be selectively connected to the slotted head 18 of the mounting bracket 14 by passing the finial cap 30 into the end of the elongated slot 20 and then moving the finial cap 30 laterally into the center of the elongated slot 20. The finial cap 30 can be selectively disconnected from the mounting bracket 14 by reversing the movement and moving the finial cap 30 back to the end of the elongated slot 20.

Figure 2:
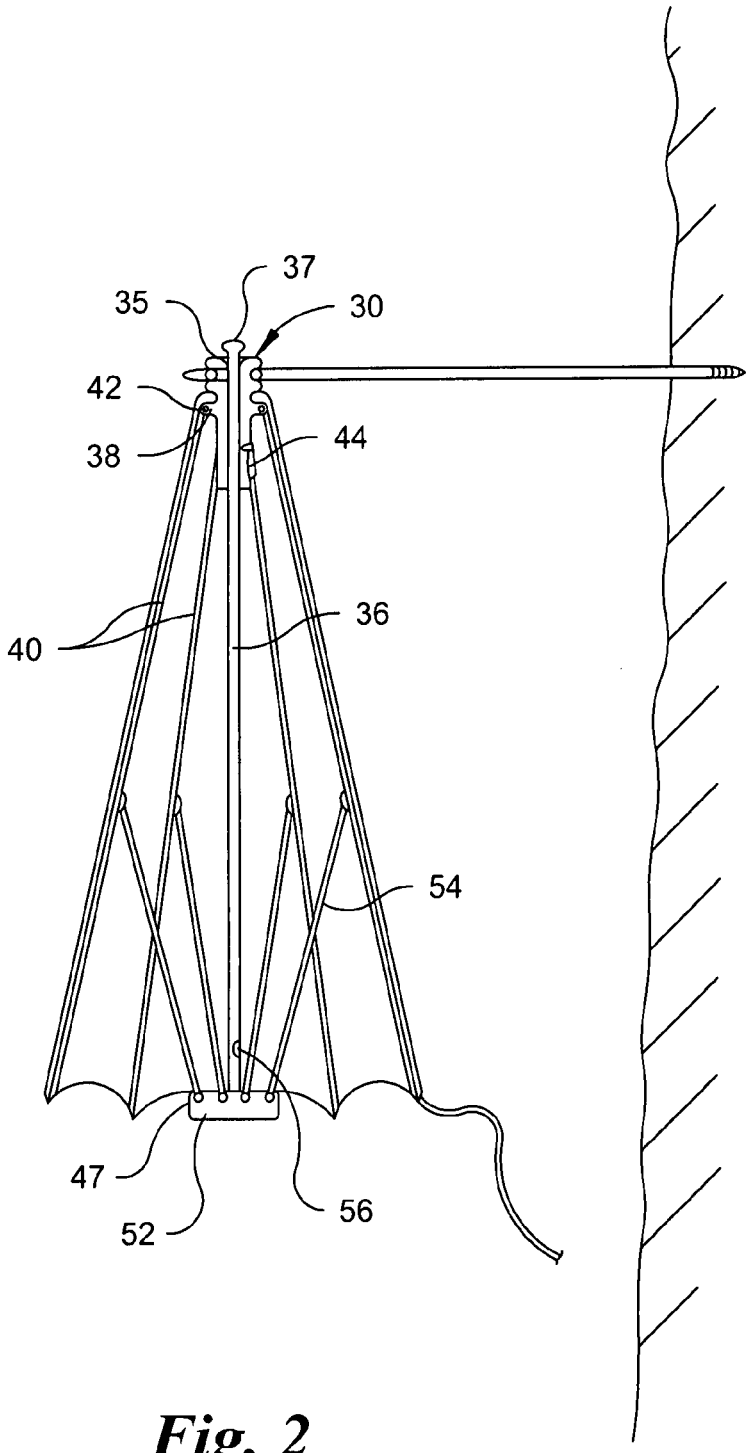
FIG. 2 is a cross-sectional view of the embodiment of FIG. 1 with the umbrella shown in a closed configuration.

Referring to FIG. 2, it can be seen that the finial cap 30 is an annular structure that defines a central opening 35. The support post 36 of the umbrella 12 extends through the central opening 35 in the finial cap 30. There is no interconnection between the support post 36 of the umbrella 12 and the central opening 34 in the finial cap 30. As such, the support post 36 is free to slide through the structure of the finial cap 30. The support post 36 terminates at its top with an enlarged head 37. The enlarged head 37 prevents the support post 36 from being pulled downwardly out of the bottom of the central opening 34 in the finial cap 30.

The finial cap 30 has a base 38 that extends under the canopy 32 of the umbrella 12. The rib supports 40 of the umbrella's canopy 32 connect to the base 38 of the finial cap 30 with pivoted connections 42. The canopy 32 of the umbrella 12 is connected to the rib supports 40 and is interconnected with the rib supports 40 so that the canopy 32 either expands or collapses with the movement of the rib supports 40.

A locking mechanism 44 is disposed below the base 38 of the finial cap 30 and is manufactured as part of the same assembly as the finial cap 30. The locking mechanism 44 contains a locking pawl that can be used to selectively engage a detent in the support post 36.

A hub 52 is provided at the along the support post 36. Linkage arms 54 extend upwardly from the hub 52. The linkage arms 54 connect to the hub 52 with pivoted connections 47. The linkage arms 54 extend upwardly and intersect the rib supports 40 of the umbrella 12. Again, the linkage arms 54 interconnect with the rib supports 40 at free pivoting connections 47.

Figure 3:
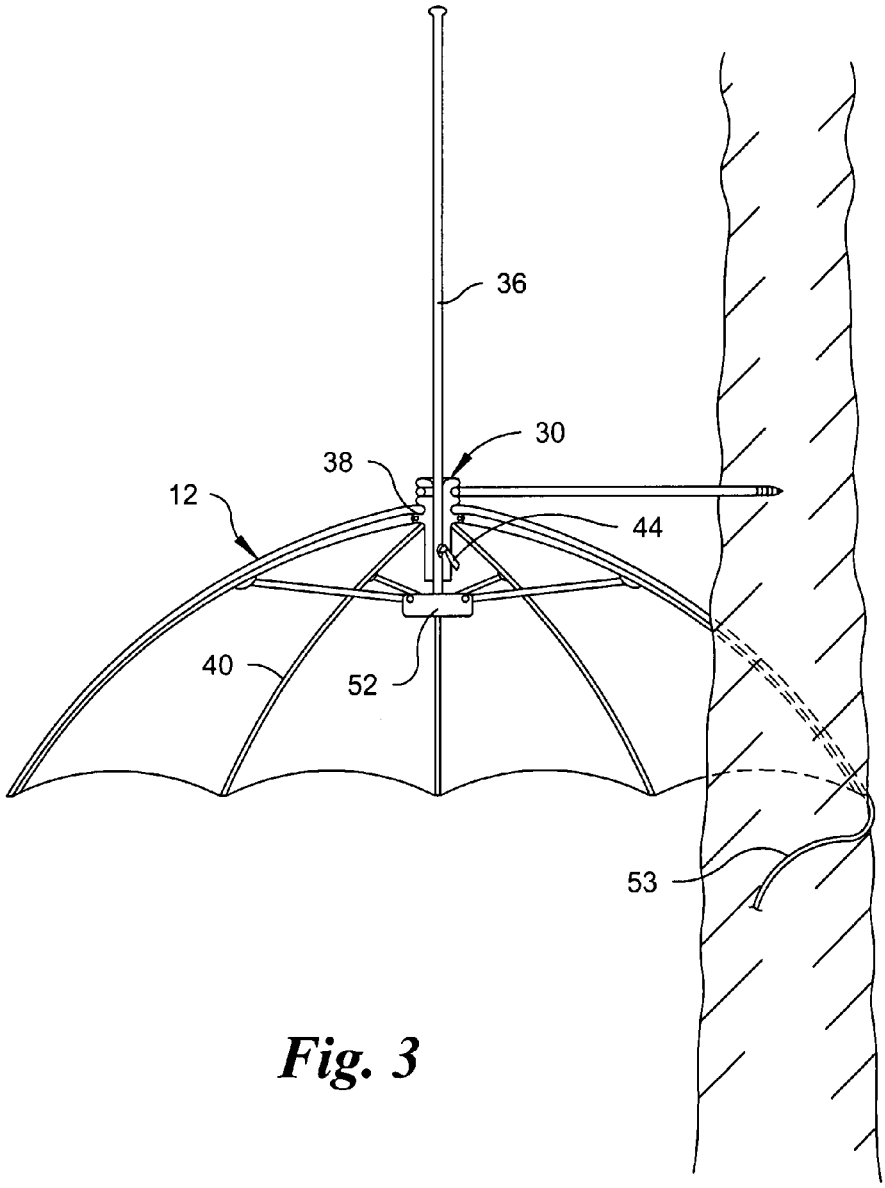
FIG. 3 is a cross-sectional view of the embodiment of FIG. 1 with the umbrella shown in an open configuration.

Referring now to FIG. 3, it can be seen that when the hub 52 of the umbrella 12 is pushed upwardly, the support post 36 is also pushed upwardly. This causes the support post 36 to pass through the central opening 34 in the finial cap 30. The top of the support post 36 therefore extends out from above the canopy 32.

As the hub 52 moves upwardly toward the finial cap 30, the linkage arms 54 push up the rib supports 40. The rib supports 40 extend outwardly and open the canopy 32 of the umbrella. A locking detent 56 (FIG. 2) is disposed on the support post 36. When the canopy 32 of the umbrella 12 is fully opened, the locking mechanism 44 below the base 38 of the finial cap 30 engages the locking detent and locks the umbrella 12 into an open position. To close the umbrella 12, the locking mechanism 44 is pressed and the hub 52 with support post 36 is again free to move away from the finial cap 30. This allows the rib supports 40 to descend and the canopy 32 to collapse.

Referring back to FIG. 1, it will be understood that to utilize the present invention assembly 10, the mounting bracket 14 is first screwed into an object, such as a tree 11. This is done by rotating the slotted head 18 of the mounting bracket 14. The rotation of the slotted head 18 of the mounting bracket 14 can be stopped at any point. As such, the slotted head 18 of the mounting bracket 14 can be oriented in the horizontal plane, vertical plane or any plane there between.

Referring now to FIG. 2, it can be seen that the finial head 30 of the umbrella 12 is inserted into the slotted head 18 of the mounting bracket 14 so that the mounting bracket 14 engages the groove in the finial head 30. This locks the umbrella 12 in place relative to the mounting bracket 14.

Referring lastly to FIG. 3, it can be seen that once the umbrella 12 is engaged with the mounting bracket 14, the umbrella 12 can be opened. The mounting bracket 14 supports the umbrella 12 from above the canopy 32 of the umbrella 12. Furthermore, the support post 36 of the umbrella 12 extends through the finial cap 30 and extends above the canopy 32 of the umbrella 12 once it is opened. This leaves the area under the canopy 32 clear for a person to move.

The canopy 32 of the umbrella 12 can be made small enough so that radius of the canopy is smaller than the length of the mounting bracket 14. However, in the shown embodiment, the radius of the canopy 32 is larger than the length of the mounting bracket. In such an embodiment, a recess is formed in the canopy 32 into which the trunk of a tree can pass. Tethers 53 are provided on the canopy 32 on either side of the recess. The tethers 53 enable the canopy to be firmly tied around the trunk of the tree.

The canopy 32 of the umbrella 12 can be tied around the trunk of the tree using the tethers 53. However, it not tied, a person can change the orientation of the umbrella's canopy 32 by rotating the mounting bracket 14. Thus, the support post 36 of the umbrella 12 can be held in the vertical, in the horizontal or in any position in between. An assembly is therefore provided that provides a strong holding support for an umbrella 12 that is positioned above the canopy 32 of the umbrella 12. An assembly is also provided that holds an umbrella 12 in a manner that the support post 36 of the umbrella 12 does not extend below the open umbrella 12, leaving the area under the umbrella 12 free and clear for movement of a person.

It will be understood that the embodiment of the present invention assembly that has been illustrated and described is merely exemplary and that an expert in the field can make variations to the shown embodiment. For example, the size and shape of the umbrella's canopy can be altered in any manner to reflect the design preferences of the manufacturer. Furthermore, the configuration of the elongated slot in the slotted head of the mounting bracket can be altered into configurations other than what is shown. All such alternate embodiments are intended to be included within the scope of the present invention as defined below by the claims.

What is claimed is:

1. An assembly, comprising:

a mounting bracket having a shaft that terminates at one end with a shaped head; and an umbrella being adjustable between an open configuration and a closed configuration, said umbrella having a support post and a top that terminates with an annular finial cap, wherein said umbrella is selectively moved between said open configuration and said closed configuration by sliding said support post through said annular finial cap, and wherein said finial cap is selectively received and engaged by said shaped head of said mounting bracket, wherein said mounting bracket supports said umbrella by said finial cap.

2. The assembly according to claim 1, wherein said shaped head of said mounting bracket defines a slot, wherein said slot selectively receives and retains said finial cap of said umbrella.

3. The assembly according to claim 1, wherein said shaft of said mounting bracket has a pointed end opposite said shaped head.

4. The assembly according to claim 3, wherein said pointed end is threaded.

5. The assembly according to claim 1, wherein said annular finial cap defines a central opening, wherein said support post extends through said central opening of said finial cap.

6. The assembly according to claim 5, wherein said umbrella further includes:

a handle disposed at an end of said support post;

support ribs coupled to said finial cap, wherein said support ribs expand outwardly when said handle is advanced toward said finial cap and said support post passes through said central opening of said finial cap; and a canopy disposed around said support ribs.

7. The assembly according to claim 6, wherein said finial cap has an upper section that extends above said canopy.

8. The assembly according to claim 7, wherein a groove is defined in said upper section of said annular finial cap that extends above said canopy, wherein said mounting bracket engages said groove.

9. The assembly according to claim 7, wherein said annular finial cap has a lower section that extends below said canopy.

10. The assembly according to claim 9, further including a locking mechanism supported by said lower section of said finial cap for selectively engaging said support post.

11. The assembly according to claim 9, further including a hub coupled to said handle and linkage elements that extend between said hub and said support ribs.

12. A method of attaching an umbrella canopy to a tree, comprising the steps of:

providing an umbrella having a support post, a canopy and a finial cap that extends above said canopy, wherein said support post extends upwardly through said finial cap when said canopy is opened;

providing a mounting bracket having a shaft and a shaped head, wherein said shaped head is sized to selectively receive and engage a portion of said finial cap;

driving said shaft of said mounting bracket into a tree; and connecting said finial cap of said umbrella to said shaped head of said mounting bracket, wherein said mounting bracket attaches said umbrella to the tree.

* * * * *